US007294052B2

(12) United States Patent
Dolan et al.

(10) Patent No.: US 7,294,052 B2
(45) Date of Patent: Nov. 13, 2007

(54) CONTROL FOR DUAL STEPPER MOTORS

(75) Inventors: Robert P. Dolan, Syracuse, NY (US); Douglas C. Lynn, Syracuse, NY (US)

(73) Assignee: Carrier Corporation, Farmington, CT (US)

( * ) Notice: Subject to any disclaimer, the term of this patent is extended or adjusted under 35 U.S.C. 154(b) by 470 days.

(21) Appl. No.: 10/909,884

(22) Filed: Aug. 2, 2004

(65) Prior Publication Data

US 2006/0025066 A1 Feb. 2, 2006

(51) Int. Cl.
*F24F 13/15* (2006.01)

(52) U.S. Cl. ..... 454/285; 454/202; 454/314

(58) Field of Classification Search ..... 454/155, 454/153, 285, 202, 313, 314, 265
See application file for complete search history.

(56) References Cited

U.S. PATENT DOCUMENTS 5,242,325 A * 9/1993 Nukushina ..... 454/285
5,379,609 A * 1/1995 Matsumoto et al. ..... 62/262
5,743,103 A * 4/1998 Taniguchi et al. ..... 62/186
5,775,989 A * 7/1998 Choi ..... 454/285
6,012,297 A * 1/2000 Ichishi et al. ..... 62/179
6,170,274 B1 * 1/2001 Ichishi et al. ..... 62/179
6,171,185 B1 * 1/2001 Jeong ..... 454/229
6,347,987 B1 * 2/2002 Ichishi et al. ..... 454/75
2003/0072675 A1 * 4/2003 Takeda et al. ..... 422/22

OTHER PUBLICATIONS

KR 9306064 B, Abstract, "Louver control System . . . ", Jul. 3, 1993 image unavailable.*

* cited by examiner

*Primary Examiner*—Gregory Wilson
(74) *Attorney, Agent, or Firm*—Marjama Muldoon Blasiak & Sullivan LLP

(57) ABSTRACT

In an air handling unit for discharging a flow of air into the surrounding ambient, having a series of horizontal louvers and a series of vertical louvers mounted in the discharge flow. A first multi-phase stepper motor is arranged to step the horizontal louvers to deflect the air flow in a vertical direction and a second multi-phase stepper motor is arranged to step vertical louvers to deflect the flow in a transverse direction. A controller is programmed to alternately apply power from a single power source to each of the motors during each phase to step each motor in equal increments during each phase.

10 Claims, 5 Drawing Sheets

| STEPPER 1 | A | AB | B | BC | C | CD | D | DA |
|---|---|---|---|---|---|---|---|---|

FIG.5

| STEPPER 1 | A | OFF | AB | OFF | B | OFF | BC | OFF | C | OFF | CD | OFF | D | OFF | DA | OFF |
|---|---|---|---|---|---|---|---|---|---|---|---|---|---|---|---|---|
| STEPPER 2 | OFF | A | OFF | AB | OFF | B | OFF | BC | OFF | C | OFF | CD | OFF | D | OFF | DA |

FIG.6

CONTROL FOR DUAL STEPPER MOTORS

FIELD OF THE INVENTION

This invention relates to an air handling system and, in particular, to a louver assembly for deflecting the flow of air that is being exchanged between the system and the surrounding ambient to expand the flow pattern of the discharged air.

BACKGROUND OF THE INVENTION

In many air handling systems and in particular, air conditioning systems, the conservation of both space and energy is of primary concern. Most room air conditioning units in use today are mounted in compact cabinets with the conditioned air being discharged from the unit through an elongated opening that extends horizontally across the face of the unit cabinet.

Typically, a series of parallelly aligned horizontal louvers are mounted in the discharge opening of the cabinet and a series of vertically aligned louvers are mounted behind the horizontal louvers. The horizontal louvers are connected to a programmed stepper motor by a rocker arm arrangement. The motor is programmed through the system controller to move the horizontal louvers a given number of steps in one direction and then a given number of steps in the opposite direction to establish a vertically expanded discharge air pattern which considerably enhances the units area of coverage. The vertical louvers in this arrangement can only be adjusted manually to change the direction of flow but not to expand the flow pattern.

To further expand the flow pattern in this type of system, a second stepper motor may be included which acts again through a linkage arrangement to step the louver a given number of steps in one direction and a given number of steps in the opposite direction to establish a further horizontally expanding the discharge flow pattern. The use of a second stepper motor typically required a second transformer to power the addition stepper motor or alternatively, a larger power supply. This approach resulted in the need for considerably more space in the power supply section of the unit and an increase in the unit cost as well as an increase in the amount of energy consumed by the unit.

SUMMARY OF THE INVENTION

It is therefore an object of the present invention to improve air handling units and in particular air conditioning units.

It is a further object of the present invention to expand the discharge air flow pattern of an air conditioning unit without considerably increasing the size of the unit.

A still further object of the present invention is to increase the discharge flow pattern of an air conditioning unit without increasing the amount of energy that is consumed.

These and other objects of the present invention are attained by air handling unit that includes a series horizontally disposed louvers and a series of vertically disposed louvers that are movably mounted in the discharge air flow of the unit. A first multi-phase stepper motor is arranged to move the horizontal louvers a given number of steps in one direction and a given number of steps in the opposite direction. A second multi-phase stepper motor is arranged to similarly move the vertical louvers a given number of steps in one direction and a given number steps in the opposite direction. A single transformer provides power to both of the stepper motors. The unit controller is programmed to apply power alternately to the two stepper motors during each motor phase to step each motor in equal increment without any considerable loss of torque or increase in power consumption.

BRIEF DESCRIPTION OF THE DRAWINGS

For a better understanding of these and objects of the invention, reference will be made to the following detailed description of the invention which should be read in association with the accompanying drawings, where:

FIG. 5 is a diagram illustrating a prior art program that employs half steps to energize a single multi-phase stepper motor; and FIG. 6 is a diagram illustrating the program approach of the present invention for energizing two multi-phase stepper motors from a single power supply.

DETAILED DESCRIPTION OF THE INVENTION

Figure 1:
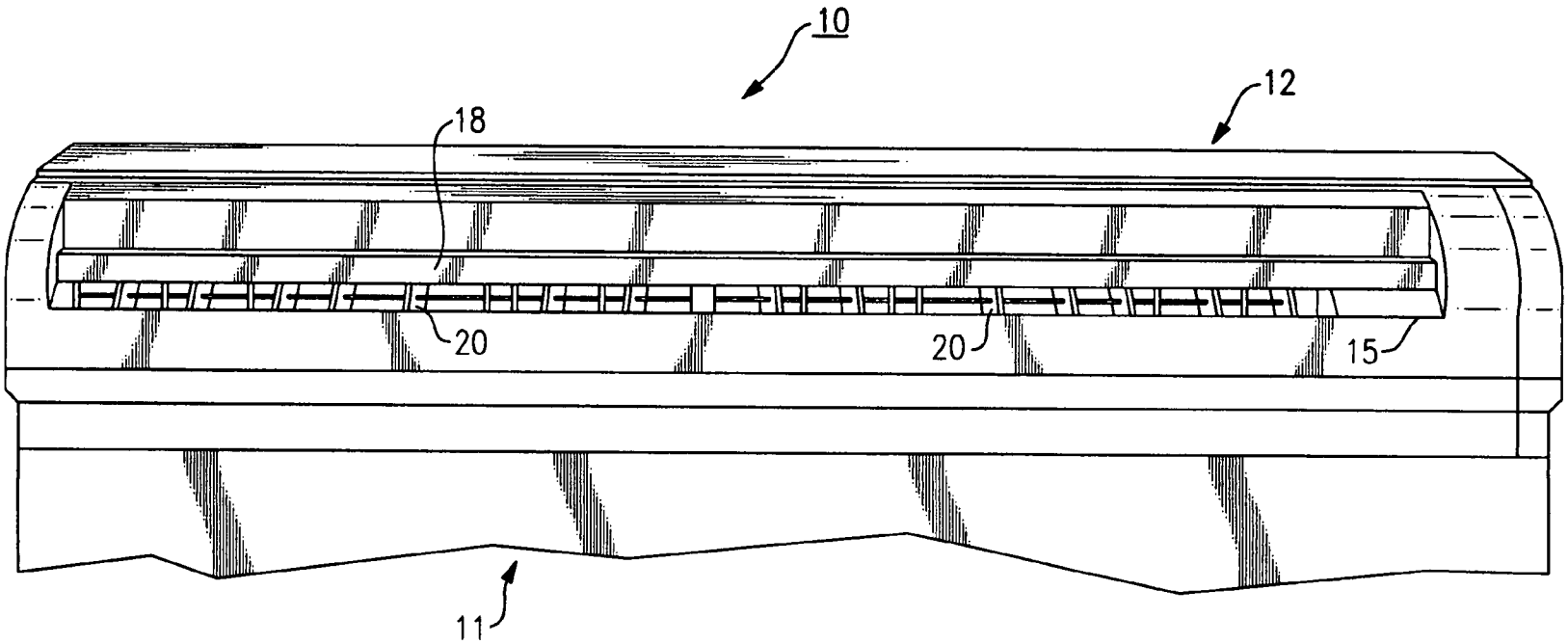
FIG. 1 is a partial front view of an air conditioning unit that embodies the teachings of the present invention.

Referring initially to FIG. 1, there is illustrated an air conditioning unit, generally referenced 10, that embodies the teachings of the present invention. The unit includes an enclosed cabinet having a removable top cover 12 in which an elongated opening 15 is provided through which a flow of condition air is discharged from the unit into the surrounding ambient. Although the present invention will be described with specific reference to an air conditioning unit, it should be evident from the disclosure below that the invention has broader application and may be used in any suitable air handling system in which air is exchanged between the system and the surrounding ambient. A pair of horizontally disposed louvers 18 are mounted within the discharge opening for deflecting the discharge airflow of conditioned air in a vertical direction. A series of vertically disposed louvers 20 are mounted adjacent to and behind the horizontal louvers within the discharge flow for deflecting the flow in a horizontal direction.

Figure 2:
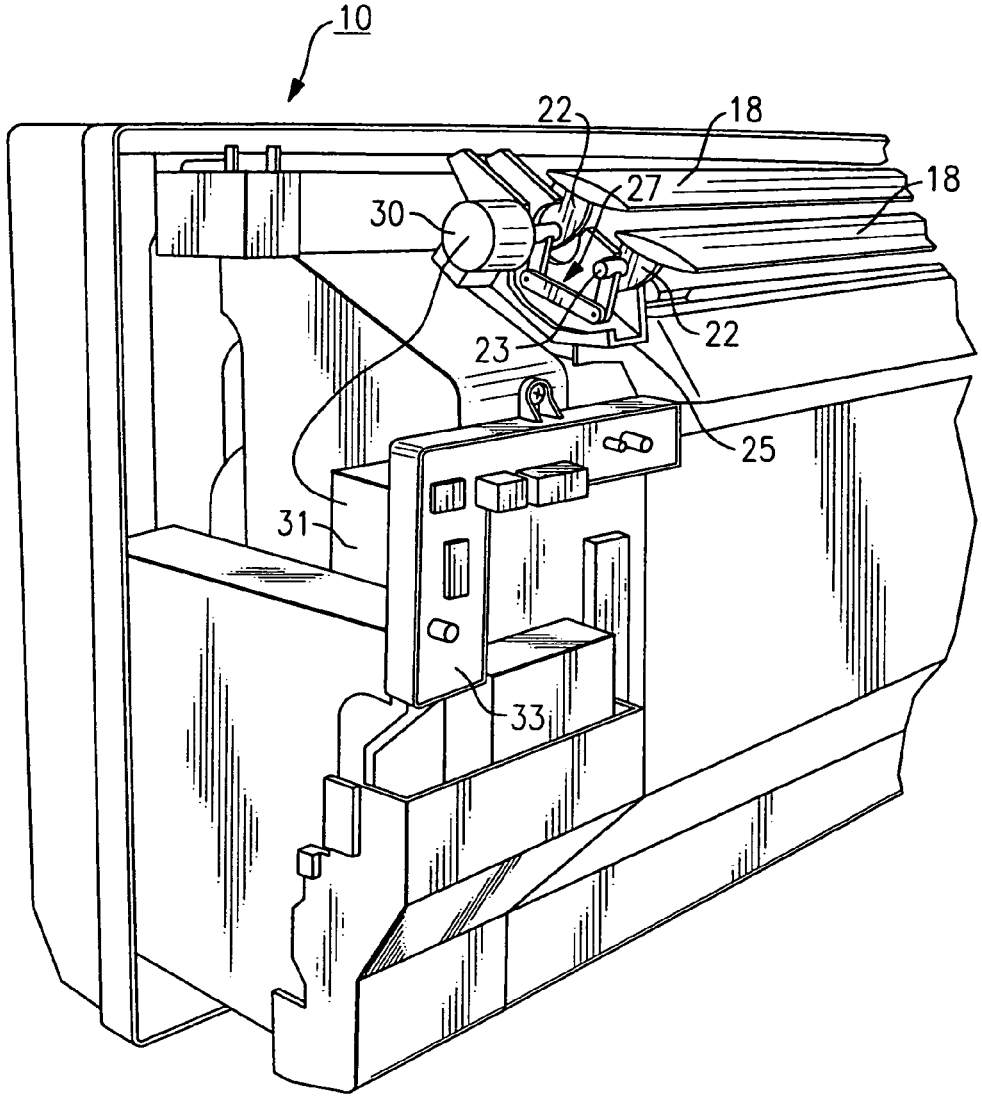
FIG. 2 is a partial perspective view illustrating a rocker arm assembly for coupling a first stepper motor to a series of horizontally disposed louvers that are mounted in the discharge flow of the unit.
Figure 3:
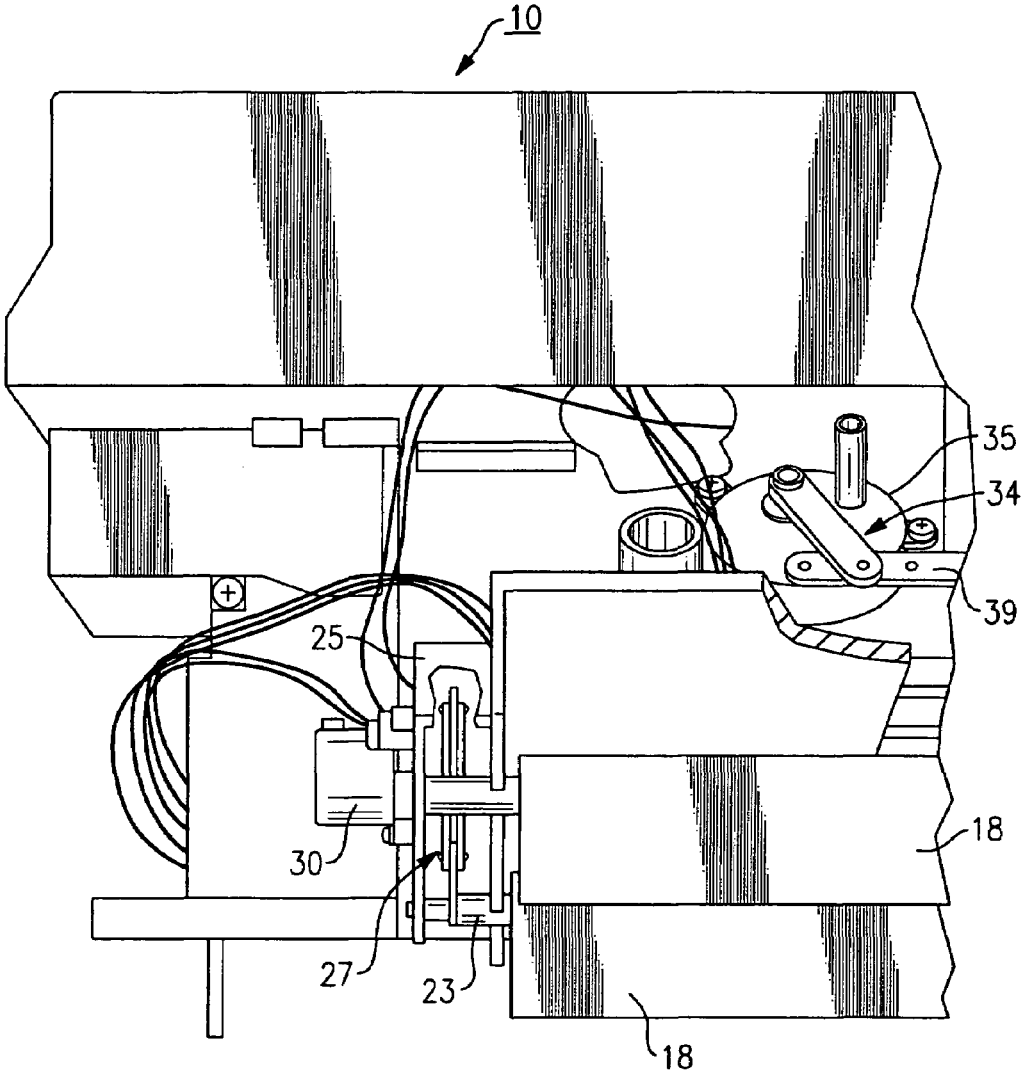
FIG. 3 is a partial side elevation showing the dual stepper motor arrangement of the present invention.

With further reference to FIGS. 2–3 the horizontal louvers contain end pieces 22 each having a stub shaft 23 that is rotatably supported within a mounting bracket 25 located at each end of the louver. The stub shafts at one end of the louver pass outwardly from the supporting mounting bracket and the two shafts are connected by a linkage 27 so that the two coupled shafts turn together in unison. One of the stub shafts is coupled to a first multi-phase stepper motor 30 that is capable of stepping the shaft in both a clockwise and a counterclockwise direction. The stepper motor is connected to a programmable controller that is located behind the unit control panel 33.

Figure 4:
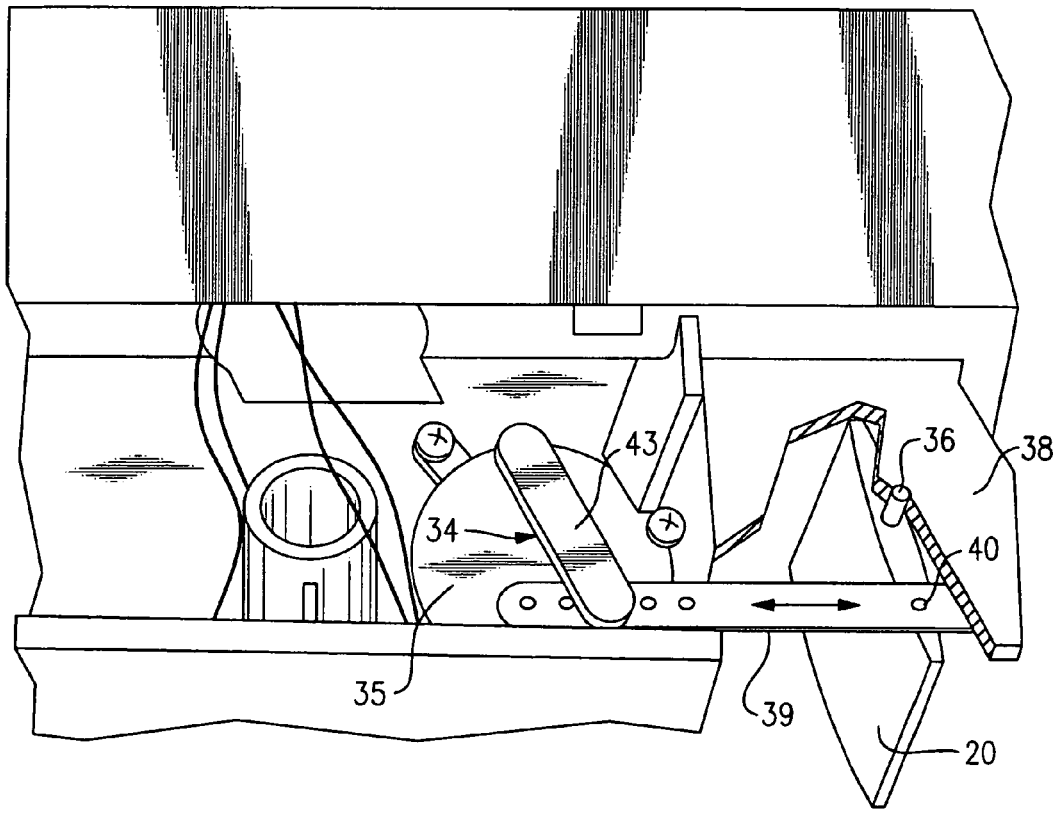
FIG. 4 is a partial perspective view illustrating a drive unit for coupling a second stepper motor to a series of vertically disposed louvers that are mounted in the discharge flow of the unit.

Turning now to FIGS. 3 and 4 there is illustrated a second linkage arrangement 34 for connecting each of the vertical disposed louvers 20 to a second multi-phase stepper motor 35. Each vertical louver in the series is mounted upon a vertical shaft 36 that is rotatably supported in a mounting bracket 38. An elongated arm 39 is slidably contained within a guide (not shown) so that the arm can reciprocate along a linear path of travel as indicated by the arrow shown in FIG. 4. The arm, in turn, is coupled by a pin 40 to an outer edge of each vertical louver so that the louvers turn together in unison as the arm reciprocates. One end of the arm 39 is connected to the second stepper motor 35 by a rocker arm 43. Here again the motor has the capability to step the motor in both a clockwise or a counterclockwise direction in response to the controller program.

As noted above, a microprocessor based control has been employed in the prior art for controlling a single stepper motor to position a series of vertically disposed louvers to deflect a flow of conditioned air that is discharged from an air conditioning unit and thus expand the discharge flow in a horizontal direction. The stepper motor is powered by a transformer having an output that is matched to the stepper motors demands. For space and power output requirements a four phase motor is utilized in the prior art system, the phases being identified in FIG. 5 as A, B, C, and D. In this system half steps are used to energize the four phases. Power is supplied to the motor in the programmed sequence illustrated in FIG. 5 with the illustrated pattern then repeating itself. In operation, the motor is programmed to be stepped a first desired number of steps in one direction and then a second number of steps in the opposite direction.

Our new programmed approach is arranged to control two separate stepper motors using the same size transformer as that employed in the single motor system. The new approach is diagrammed in FIG. 6 and shown in the same time sequence as the prior art approach where the transformer is used to energize a single stepper motor. As shown, during each half step sequence, power from the transformer is provided to one of the motors during the first part of the half step sequence and to the second motor during the remainder of the sequence. By so alternating the power through the four phases sufficient torque is produced in each motor to complete the half step energizing cycles and the amount of time required to complete the four phase sequence is the same as that found in the prior art single motor application. Accordingly, each of the motors is stepped at the same speed to create a uniform discharge pattern that is expanded both horizontally and vertically as the louvers sweep back and forth throughout the programmed path of travel without an increase in power consumption or the need for additional space.

While the present invention has been particularly shown and described with reference to the preferred mode as illustrated in the drawing, it will be understood by one skilled in the art that various changes in detail may be affected therein without departing from the spirit and scope of the invention as defined by the

We claim:

1. An air handling unit that includes:

a cabinet having an elongated air flow opening through which air is discharged into the surrounding ambient;

at least one horizontal louver mounted in said opening upon a horizontally disposed shaft;

a first multi-phase stepper motor for stepping said horizontally disposed shaft;

at least one vertical louver mounted in the discharge flow upon a vertically disposed shaft;

a second multi-phase stepper motor for stepping said vertically disposed shaft; and a controller for applying power alternately to said two stepper motors from a single power supply during each phase to step each motor in equal increments.

2. The unit of claim 1 wherein each motor has a certain number of phases.

3. The unit of claim 1 wherein a series of horizontally louvers are mounted upon parallel shafts in said opening; and first connecting means for coupling each horizontally aligned shaft to said first stepper motor so that the horizontal louvers are stepped together in unison.

4. The unit of claim 3 wherein a series of vertical louvers are mounted upon parallel vertically disposed shafts; and second connecting means for coupling each vertically disposed shaft to said second stepper motor so that the vertical louvers are stepped together in unison.

5. The unit of claim 4 wherein said controller is programmed to step each stepper motor in one direction a first given number of steps and then in the opposite direction a second given number of steps.

6. The unit of claim 5 wherein the first given number of steps is equal to the second given number of steps.

7. The unit of claim 1 wherein said power supply includes a single transformer.

8. A method of controlling the movement of louver air deflectors that include the steps of:

mounting at least one horizontal louver that is secured to a horizontally disposed shaft within an air flow path;

mounting at least one vertical louver that is secured to a vertically disposed shaft within said air flow path;

connecting the horizontally disposed shaft to a first multi-phase stepper motor;

connecting the vertically disposed shaft to a second multi-phase stepper motor; and alternately applying power to said stepper motors from a single power supply during each phase to step each shaft an equal number of steps during each motor phase.

9. The method of claim 8 that includes the steps of:

mounting a series horizontal louvers within said air flow path and connecting each horizontally disposed shaft to said first multi-phase stepper motor so that the horizontal louvers are stepped together in unison.

10. The method of claim 9 that includes the further step of:

mounting a series of vertical louvers within said air flow path and connecting each vertically disposed shaft to said second stepper motor so that the vertical louvers are stepped together in unison.

* * * * *